US006692081B2

(12) United States Patent
Vik

(10) Patent No.: US 6,692,081 B2
(45) Date of Patent: Feb. 17, 2004

(54) METHODS AND CHAIR FOR SUPPORTING THE BACK OF A SEATED PERSON

(76) Inventor: David Vik, 4700 El Camino Real, Los Altos, CA (US) 94002

( * ) Notice: Subject to any disclaimer, the term of this patent is extended or adjusted under 35 U.S.C. 154(b) by 0 days.

(21) Appl. No.: 09/888,241

(22) Filed: Jun. 22, 2001

(65) Prior Publication Data

US 2001/0054836 A1 Dec. 27, 2001

Related U.S. Application Data

(63) Continuation-in-part of application No. 09/602,904, filed on Jun. 23, 2000, now Pat. No. 6,394,547.

(51) Int. Cl.[7] ..... A47B 97/00
(52) U.S. Cl. ..... 297/463.1
(58) Field of Search ..... 297/298, 353, 297/383, 344.19, 423.26, 452.29, 301.7, 301.6, 301.1, 296, 452.3, 452.31, 452.32, 344.12, 344.18, 361.1, 354.12, 284.4, 463.2

(56) References Cited

U.S. PATENT DOCUMENTS

| | | | | |
|---|---|---|---|---|
| 2,437,940 | A | | 3/1948 | Cramer et al. |
| 3,989,297 | A | | 11/1976 | Kerstholt |
| 4,043,592 | A | * | 8/1977 | Fries |
| 4,099,774 | A | | 7/1978 | Sandham |
| 5,035,466 | A | | 7/1991 | Mathews et al. |
| 5,249,839 | A | | 10/1993 | Faiks et al. |
| 5,261,723 | A | | 11/1993 | Hosoe |
| 5,385,388 | A | | 1/1995 | Faiks et al. |
| 5,553,917 | A | | 9/1996 | Adat et al. |
| 5,577,802 | A | | 11/1996 | Cowan et al. |
| 5,624,158 | A | | 4/1997 | Adat et al. |
| 6,086,157 | A | | 7/2000 | Toso |

* cited by examiner

*Primary Examiner*—Milton Nelson, Jr.
(74) *Attorney, Agent, or Firm*—Gregory Scott Smith; Gregory Smith & Associates

(57) ABSTRACT

Method and apparatus for supporting the back of a seated person by providing primary support to the back of the seated person at the junction between the lower thoracic vertebrae and the upper lumbar vertebrae and surrounding tissues. More specifically, the primary support is preferably provided to the spine in a target region between the $11^{th}$ thoracic vertebrae and the $2^{nd}$ lumbar vertebrae of a user of the chair, and more preferably between the $1^{st}$ lumbar vertebrae and the $12^{th}$ thoracic vertebrae.

11 Claims, 4 Drawing Sheets

METHODS AND CHAIR FOR SUPPORTING THE BACK OF A SEATED PERSON

CROSS-REFERENCE TO RELATED APPLICATIONS

This is a continuation-in-part of Utility patent application Ser. No. 09/602,904, filed Jun. 23, 2000, now U.S. Pat. No. 6,394,547.

FIELD OF THE INVENTION

The present invention relates generally to methods for supporting the back of a seated person, and to ergonomic chairs or seats and adjustable backrests configured to accomplish the method of the invention.

DESCRIPTION OF RELATED ART

The human spinal column comprises a series of vertebral blocks extending from the occiput to the sacrum, or tailbone. The individual vertebra are united by longitudinal ligaments and by intervertebral discs disposed between laminae of cartilage. The spinal vertebra house the spinal cord and provide intervertebral outlets through which pass spinal nerves extending from the spinal cord.

Many experts believe that back pain or dysfunction will afflict 80% or more of the human population at some point in their lives. One presumed cause of back injury and dysfunction stems from poor posture. Poor posture can cause misalignment of the vertebra or degeneration of the intervertebral discs, which combined with compression of the spinal column from the weight of the upper body, can result in pinching and impingement of the spinal nerves. Pinching of the nerves can cause pain and impingement can interfere with the flow of neurological impulses, which can lead to various muscular disabilities. Moreover, even slight malalignments of the spinal column, though not permanent or injurious to the nerves, may cause muscles associated with the spine to fatigue, cramp, or spasm. In either case, the ailing individual feels pain.

A very large number of articles for sitting, hereafter collectively referred to as chairs, are available on the market, many of which purport to provide comfortable and ergonomically effective support and to encourage proper posture in order to prevent spine related problems such as those discussed above. However, the method of support employed by the pre-existing chairs does not provide the best biomechanical support for the spine. Also, such pre-existing chair designs are frequently complicated and expensive.

Furthermore, while many of these seats or chairs can be adjusted to suit a particular individual when seated in a single position, the chairs do not generally provide effective ergonomic support of the spine if the user moves. For example, the spatial relationship between the backrest and the seat of a chair in many pre-existing chair designs will change to a negative or less comfortable relationship with the user's back when the user leans back in the seat or chair.

What is needed is a method of supporting the back of a seated person that provides back support that is superior to the support provided by preexisting methods implemented using preexisting chair designs. What is also needed is a chair and backrest configuration that allows the use of the improved method and that is adaptable for use in many kinds of seating.

SUMMARY OF THE INVENTION

Accordingly, the present invention comprises a method for supporting the back of a seated person. The method is intended to provide primary support to the back of a seated person at the junction between the lower thoracic vertebrae and the upper lumbar vertebrae and surrounding tissues. More specifically, the primary support is preferably provided to the spine in a target region generally around the $11^{th}$ thoracic vertebrae and the $2^{nd}$ lumbar vertebrae of a user of the chair, and more preferably between the $1^{st}$ lumbar vertebrae and the $12^{th}$ thoracic vertebrae, inclusive.

Support in the target region assists the spine of a seated person in maintaining a preferred posture, and also partially supports the weight of the spine above the lumbar region of the spine, which reduces the compressive forces experienced by the lumbar region of the spine. The method of the invention generally includes the following steps: (a) providing a backrest including a primary support region on the front surface of the backrest, and wherein the backrest is positionable to provide primary support to a target region of the spine of the seated person between the $2^{nd}$ lumbar vertebrae and the $11^{th}$ thoracic vertebrae, and (b) positioning the backrest by adjusting one or more dimensions of height, depth, and angle of the backrest so that the primary support region of the backrest contacts the target region of the spine between the $2^{nd}$ lumbar vertebrae and the $11^{th}$ thoracic vertebrae of a seated person, and more preferably between the $1^{st}$ lumbar vertebrae and the $12^{th}$ thoracic vertebrae.

In some embodiments, the method may further comprise the step (c) applying a selected amount of traction to the spine of the seated person as the backrest is deflected backwards as the seated person leans back. In such embodiments, the selected amount of traction is preferably between 1/16 inch and 1/4 inch for each 3/4 inch to 1 1/4 inch of backwards deflection of said backrest, and more preferably 1/8 inch for each 1 inch of backwards deflection of said backrest.

Preferably, In some embodiments of the method, the backrest does not provide support below the $2^{nd}$ vertebrae.

Another aspect of the invention comprises a backrest that is configured to implement the method of the invention, and which may be incorporated into many other kinds of chairs or other kinds of seating, including but not limited to car seats, sofas, seats in public transportation vehicles, airlines, airport seats, public benches, and the like. The backrest is positionable to provide primary support to the spine in the region between the $1^{st}$ lumbar vertebrae and the $12^{th}$ thoracic vertebrae of a user of the chair, and in some embodiments may also support the region between the $11^{th}$ thoracic vertebrae and the $2^{nd}$ lumbar vertebrae, inclusive. The force applied by the primary support region of the backrest to the target region comprises a vector including both a vertical component and a horizontal component. The vertical vector partially supports the weight of the user above the lumbar region of the spine preferably reducing the compressive forces experienced by the lumbar region of the spine. In a preferred embodiment, the backrest is configured not to provide support directly to the lumbar region of the spine below the $2^{nd}$ lumbar vertebrae. In other embodiments the backrest further includes a triangle-shaped protrusion for providing support to the thoracic region of the spine of the seated person. In the preferred embodiments, the primary support region is located proximate the bottom of the backrest.

A further aspect of the invention comprises a seat or chair configuration that is configured to accomplish the methods of the invention, including supporting the spine as described, and in some embodiments applying traction. Generally the chair includes a support structure, a seat operably connected to the support structure, and a backrest as previously described. In some embodiments, the backrest support structure comprises a support arm made of a sheet of resilient material having a length divided into four regions comprising a lower end section, a lower intermediate section, an upper intermediate section, and an upper end section. The depth of the seat may be adjustable by moving the lower end section of the support arm relative to a coupling affixed to the underside of the seat, and the height of the backrest may be adjustable along a length of an upper end section of the support arm. In alternate embodiments, the support arm may be coupled to the seat support structure, rather than to the underside of the seat.

In some embodiments the support structure supporting the seat includes one or more chair legs. In other embodiments, the support structure comprises a base including a mechanism for controlling and adjusting the height of the seat. Some embodiments may include a footrest. The footrest may comprise a body with a triangular cross section and an off center axis extending between the first end and the second ends. In still other embodiments, the backrest includes a protrusion for providing additional support for the thoracic portion of the spine.

BRIEF DESCRIPTION OF THE DRAWINGS

The features of the present invention, which are believed to be novel, are set forth with particularity in the appended claims. The present invention, both as to its organization and manner of operation, together with objects and advantages provided by the invention, may best be understood by reference to the following description, taken in connection with the accompanying drawings, in which:

DETAILED DESCRIPTION OF THE INVENTION

Figure 1:
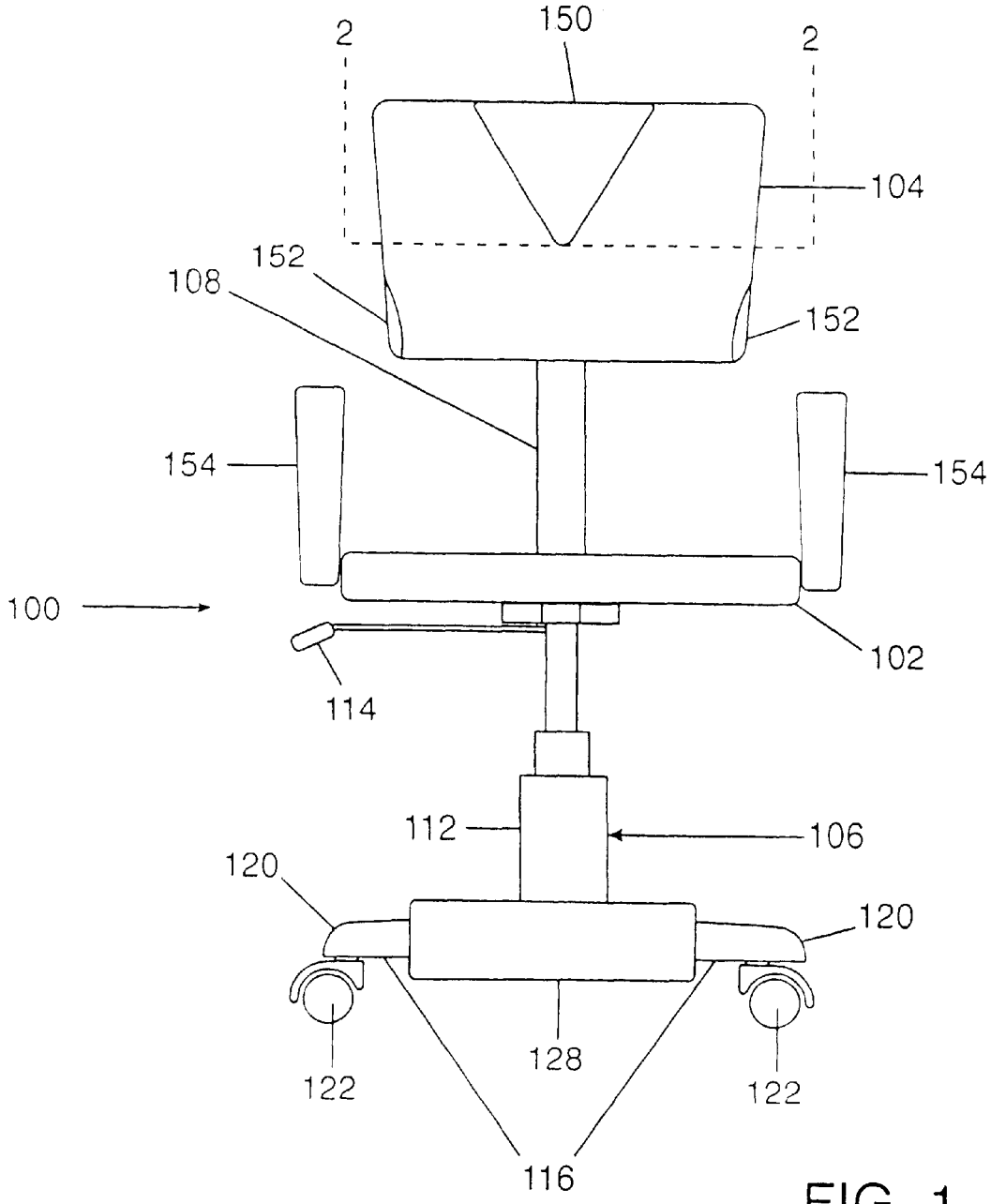
FIG. 1 shows a front view of a desk chair including a backrest configured to implement the method of the invention.

The present invention comprises a method for supporting the back of a seated person. The method is intended to provide primary support to the back of a seated person at the junction between the lower thoracic vertebrae and the upper lumbar vertebrae and surrounding tissues. More specifically, the primary support is preferably provided to the spine in a target region between the $11^{th}$ thoracic vertebrae and the $2^{nd}$ lumbar vertebrae of a user of the chair, and more preferably between the $1^{st}$ lumbar vertebrae and the $12^{th}$ thoracic vertebrae. Primary support is preferably defined herein to mean the amount of support necessary to be applied to the target region of the spine in order to encourage the desired posture. While support may be provided over a larger area of the seated person's back than the target region, the pressure per given unit of surface area is preferably higher in the target region than elsewhere on the seated person's back.

It is well known that there is a preferred curvature of the spine that should be maintained when sitting. Detailed descriptions of the human spine and the preferred conformation of the spine when sitting are discussed in *The Physiology of Joints*, I. A. Kapandji, 1979, which is hereby incorporated by reference in its entirety. Support in the target region assists the spine in maintaining a preferred posture, and also partially supports the weight of the spine above the lumbar region of the spine, which reduces the compressive forces experienced by the lumbar region of the spine. Proper support of the spine is very important, particularly for individuals who are seated for long periods of time. In addition to increased comfort, benefits gained by the posture encouraged by the method of the invention may include decreases in spinal osteoarthritis, disc degeneration, bone remodeling due to unnatural stresses applied to the spine, and disease processes caused by organ compression and poor posture. Additional benefits may include increases in spinal fluid flow, respiration and oxygen flow, spinal mobility, proper muscle integrity, blood flow, digestion, organ function, nerve transmission, and disc and spinal function.

The present invention also comprises a backrest configuration that accomplishes the method of the invention by supporting the users back at the junction between the lower thoracic vertebrae and the upper lumbar vertebrae and surrounding tissues. Another aspect of the invention comprises a seat or chair configuration that provides a selected degree of traction applied to the lumbar region of the spine when the user leans back in the seat or chair.

The method of the invention generally includes the following steps: (a) providing a backrest including a primary support region on the front surface of the backrest, and wherein the backrest is positionable to provide primary support to a target region of the spine of the seated person generally around the $2^{nd}$ lumbar vertebrae and the $11^{th}$ thoracic vertebrae, and (b) positioning the backrest by adjusting one or more dimensions of height, depth, and angle of the backrest so that the primary support region of the backrest contacts the target region of the spine between the $2^{nd}$ lumbar vertebrae and the $11^{th}$ thoracic vertebrae of a seated person, and more preferably between the $1^{st}$ lumbar vertebrae and the $12^{th}$ thoracic vertebrae.

In some embodiments, the method may further comprise the step (c) applying a selected amount of traction to the spine of the seated person as the backrest is deflected backwards as the seated person leans back. In such embodiments, the selected amount of traction is preferably between 1/16 inch and 1/4 inch for each 3/4 inch to 1 1/4 inch of backwards deflection of said backrest, and more preferably 1/8 inch for each 1 inch of backwards deflection of said backrest. The traction applied to the spine provides several benefits including but not limited to increased comfort, encouragement of correct posture of the spine while leaning back, and maintenance of contact between the primary support region of the backrest and the target region of the spine.

Preferably, the force applied by the primary support region of the backrest to the target region of the spine comprises a vector including both a vertical component and a horizontal component. In some embodiments of the method, the backrest does not provide support below the $2^{nd}$ vertebrae. In other embodiments the backrest further includes a triangle-shaped protrusion for providing support to the thoracic region of the spine of the seated person. In the preferred embodiments, the primary support region is located proximate the bottom of the backrest.

An example configuration of a backrest and chair configured to accomplish the methods of the invention will be described in the figures and the text below. An office chair is shown in FIGS. 1–6, however, the method of the invention may be implemented by backrests incorporated into many other kinds of chairs or other kinds of seating, including but not limited to car seats, sofas, seats in public transportation vehicles, airlines, airport seats, public benches, and the like.

Referring to FIGS. 1 through 6, an example chair 100 generally comprises a seat 102, a backrest 104, a seat support structure 106 to support the seat 102, and a backrest support structure 108 that extends between the backrest 104 and the seat 102, although, in alternate embodiments the backrest support structure 108 could be coupled to the seat support structure 106.

Virtually any known means for supporting the seat 102 and backrest 104 may be used for the seat support structure 106, including but not limited to one or more legs, or pedestal configurations, which may or may not include wheels. The preferred seat support structure 106 in this example is a wheeled pedestal 110 that is adjustable in height. The pedestal 110, best seen in FIGS. 1 and 3, preferably comprises a telescoping column 112 that allows the height of the seat 102 to be adjusted to accommodate persons of different height or build. Any known means for adjusting the height of the column 112 may be used, however, in the preferred embodiment the telescoping column 112 is hydraulic, and includes a height adjustment arm 114 to engage and disengage a known locking system to hold the column 112 at the desired height. In this embodiment, the column 112 is under pressure, which biases the seat 102 upward. To adjust the height up, the user simply stands or otherwise removes his or her weight from the seat 102, releases the locking system using the height adjustment arm 114, and the seat 102 will rise. When the seat 102 reaches the desire level, the user re-engages the locking system using the height adjustment arm 114. To lower the seat 102, the user simply, releases the locking system using the height adjustment arm 114, then sits or otherwise places sufficient weight on the chair 100 to overcome the upward bias of the hydraulic pressure. When the seat 102 falls to the desired level, the user re-engages the locking system using the height adjustment arm 114.

The pedestal 110 preferably includes a plurality of arms 116 radiating from the bottom of the column 112 in a plane roughly perpendicular to the vertical axis of the column 112. Preferably, for stability, at least four such arms 116 radiate from the bottom end of the column 112, however, in alternate embodiments, other configurations may be used. The outer end 120 of each arm 116 preferably includes a castor or wheel structure 122 to allow the seat 102 to roll easily.

An adjustable footrest 128 is preferably coupled between two of the radiating arms. In a preferred embodiment best seen in FIG. 3, the footrest 128 is a bar or tube with a triangular cross-section, and includes an off center axis 130 running through footrest 128 from one end of the footrest 128 to the other. The use of the off center axis 130 allows the level of the footrest 128 to be adjusted by selecting between the three sides of the footrest 128. The corners of the footrest 128 are preferably rounded in order to avoid the possibility of injury to the user. In alternate embodiments the chair 100 may not include a footrest 128, or the footrest 128 may be coupled to a portion of the column 112 rather than to the radiating arms 116. Many other useable footrest configurations are known and may be apparent to one skilled in the art, and such alternate designs are comprehended to be included in the invention.

The top of the column 112 is preferably coupled to the underside of the seat. The specific apparatus or means used to couple the top of the column 112 to the underside of the seat 102 is not critical to the invention, and any known and acceptable manner or means for doing so may be used. The connection between the top of the column 112 and the underside of the seat 102 preferably includes a pivot means to allow the seat 102 to rotate around a central axis of the column 112 of the pedestal 110 in a plane horizontal to the support surface or ground. The coupling may also allow the seat 102 to tilt back, if desired.

The upper surface of the seat 102 is preferably configured to conform to the posterior of a typical user. The particular configuration of the seat 102 is not critical to the invention, and a variety of known seat 102 configurations are useable. Generally the seat 102 comprises a bottom plate made of plastic or metal over which one or more layers of padding such as rubber, foam rubber, cotton, etc., are laid, and a seat 102 cover, made of any acceptable fabric material, synthetic webbing, or the like. The seat 102 may include any known and acceptable features for increasing the comfort of the seat.

Figure 3:
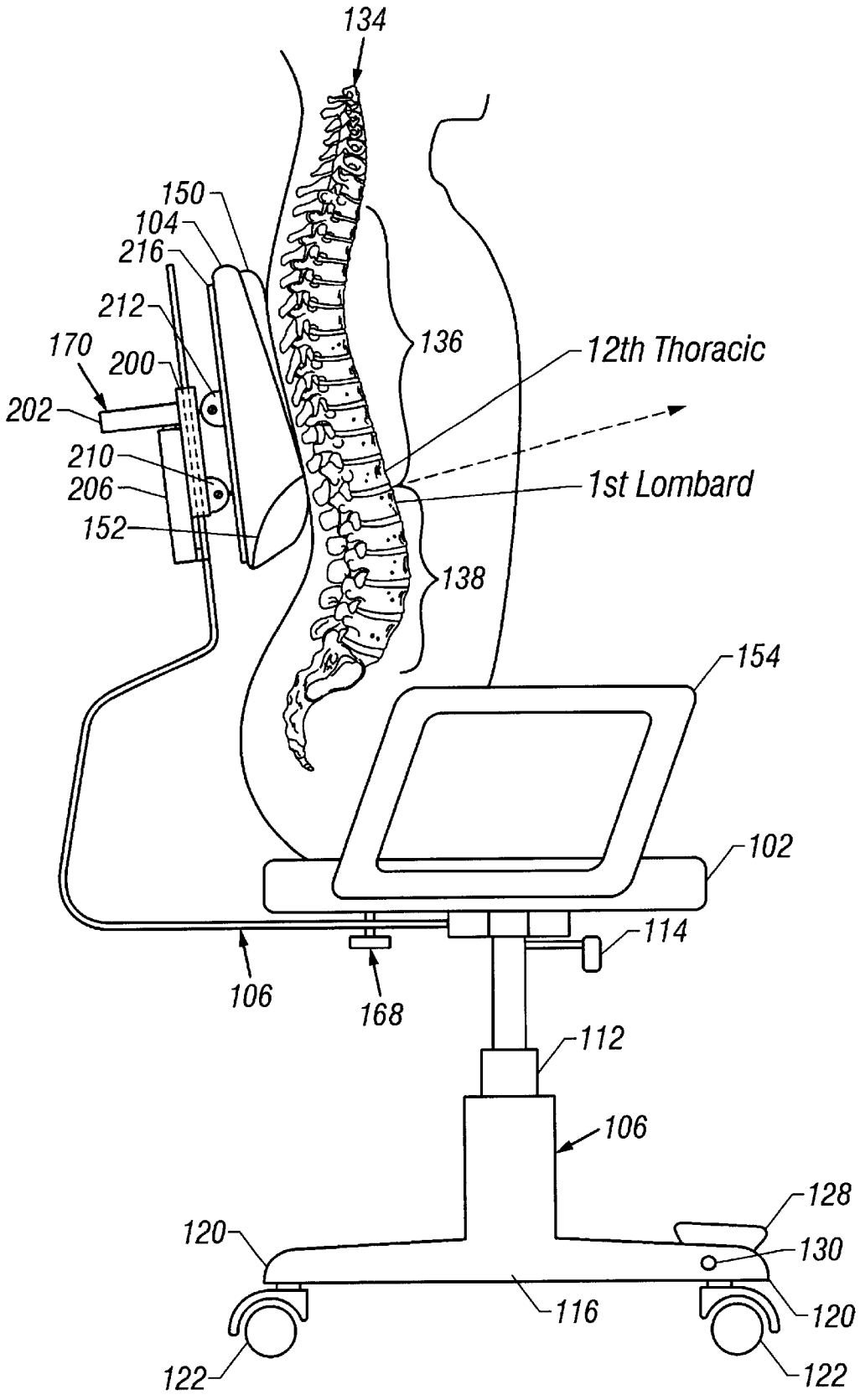
FIG. 3 shows a side view of the chair of FIG. 1 showing a user seated, and a preferred relative position of the spine and backrest.

The backrest 104 is configured to provide primary support to the spine 134, seen in FIG. 3, at the target region surrounding the junction between the lower thoracic vertebrae number 12, and the upper lumbar vertebrae number 1. The backrest is preferably adjustable in at least height, depth, and angle so as to be easily positioned at the target region. In some embodiments, the area of primary support may be somewhat larger, including the $11^{th}$ thoracic vertebrae and the $2^{nd}$ lumbar vertebrae. This provides superior support over other pre-existing designs which tend to focus only on keeping the lumbar vertebrae in the preferred curved configuration, and do not provide support or lift to the rest of the spine 134. By providing support at the location preferred in the invention, the weight of the upper portion of the "S" curve of the spine 134 is partially supported. This reduces wear on the lumbar region 136 of the spine 134, and improves the comfort of the chair 100. Providing primary support at the area between the $12^{th}$ thoracic and the $1^{st}$ lumbar vertebrae is novel, and may be is accomplished by a number of different backrest configurations comprehended by the invention.

Figure 2:
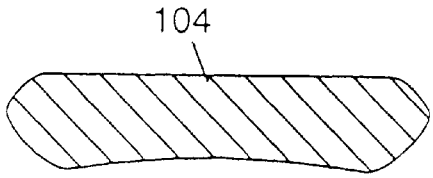
FIG. 2 shows a top cutaway view of the backrest of the chair of FIG. 1 taken along line 2—2.

One example of a backrest configuration that will accomplish the desired support is seen in the FIGS. 1, 2 and 3. Referring specifically to FIG. 2, which is a cutaway top view of the backrest 104 of FIG. 1 taken along line A—A, the backrest 104 includes a curve to promote spinal alignment. The amount of curve may be varied within reasonable limits. The angle of the surface of the backrest 104 in contact with the user is between 0 and 22.5 degrees from vertical, and more preferably approximately 12.5 degrees from vertical.

The primary support region 140 on the backrest 104 is preferably near the bottom of the backrest 104. The gap between the seat 102 and the bottom of the backrest 104 is intended to prevent lateral or side pressure against the lumbar vertebrae. Thus, the point of maximum force on the users back preferably results from the contact of the primary support region 140 on the backrest 104 against the target region or tissues roughly between the $12^{th}$ thoracic vertebrae and the $1^{st}$ lumbar vertebrae, or in some embodiments, between the $11^{th}$ thoracic vertebrae and the $2^{nd}$ lumbar vertebrae. The direction of force 124 applied to the users back at the target region preferably has both a vertical element or vector and horizontal element or vector. The vertical vector supports some of the weight of the spine 134 at the lumbar region 136, reducing the weight supported by the lumbar region 136 of the spine 134. The portions of the back rest above the primary support region 140 are intended to provide a comfortable resistance when the user leans back in the chair, and to assist the user in maintaining a proper curve of the thoracic region 138 of the spine 134. As long as the previously described features are present, the other features of the backrest 104 may be varied without leaving the scope of the comprehended invention.

In a preferred embodiment, a thoracic lift triangle 150 is also included on the backrest 104, best seen in FIG. 1. The thoracic lift triangle 150 is intended to contact the thoracic region 138 of the spine 134 to assist the user in maintaining proper posture.

In the preferred embodiment the chair 100 includes arm rests 154, however, virtually any arm rest configuration may be used, and the particular configuration selected is not critical to the invention. In alternate embodiments the chair 100 may be fabricated without armrests 154. In other embodiments, elbow alignment cut-outs 152 may be provided so that the user can pull his or her arms back on the arm rests 154 comfortably without encountering the backrest 104.

The chair 100 preferably allows the backrest 104 to move or tip back as the user leans back. Thus, an important feature in some embodiments of the invention is the application a selected degree of traction or stretching of the lumbar region 136 of the spine 134 when a user leans back in the chair. The amount of traction is preferably between approximately 1/16 inch and 1/4 inch for each approximately 3/4 inch to 1 1/4 inch of backwards deflection of the backrest, and more preferably approximately 1/8 inch for each approximately 1 inch of backwards deflection of the back rest. The traction applied to the spine may provide several benefits including but not limited to increased comfort, encouragement of correct posture of the spine while leaning back, and maintenance of contact between the primary support region of the backrest and the target region of the spine.

A preferred embodiments of the backrest support structure will now be described, however, in alternate embodiments, virtually any back rest support structure or configuration may be used so long as it provides the desired spinal traction. In a preferred embodiment, the traction may be obtained by using a backrest support arm 160 configured as shown in isolation in FIG. 4. The backrest support arm 160 is preferably constructed using steel, however, a variety of other materials may be useable. The configuration of the backrest support arm 160 may be easily varied from the description below by one skilled in the art to account for the use of a different thickness of material or the use of different materials, or the use of a backrest support arm 160 having a different cross sectional shape, without leaving the spirit and scope of the invention.

Figure 4:
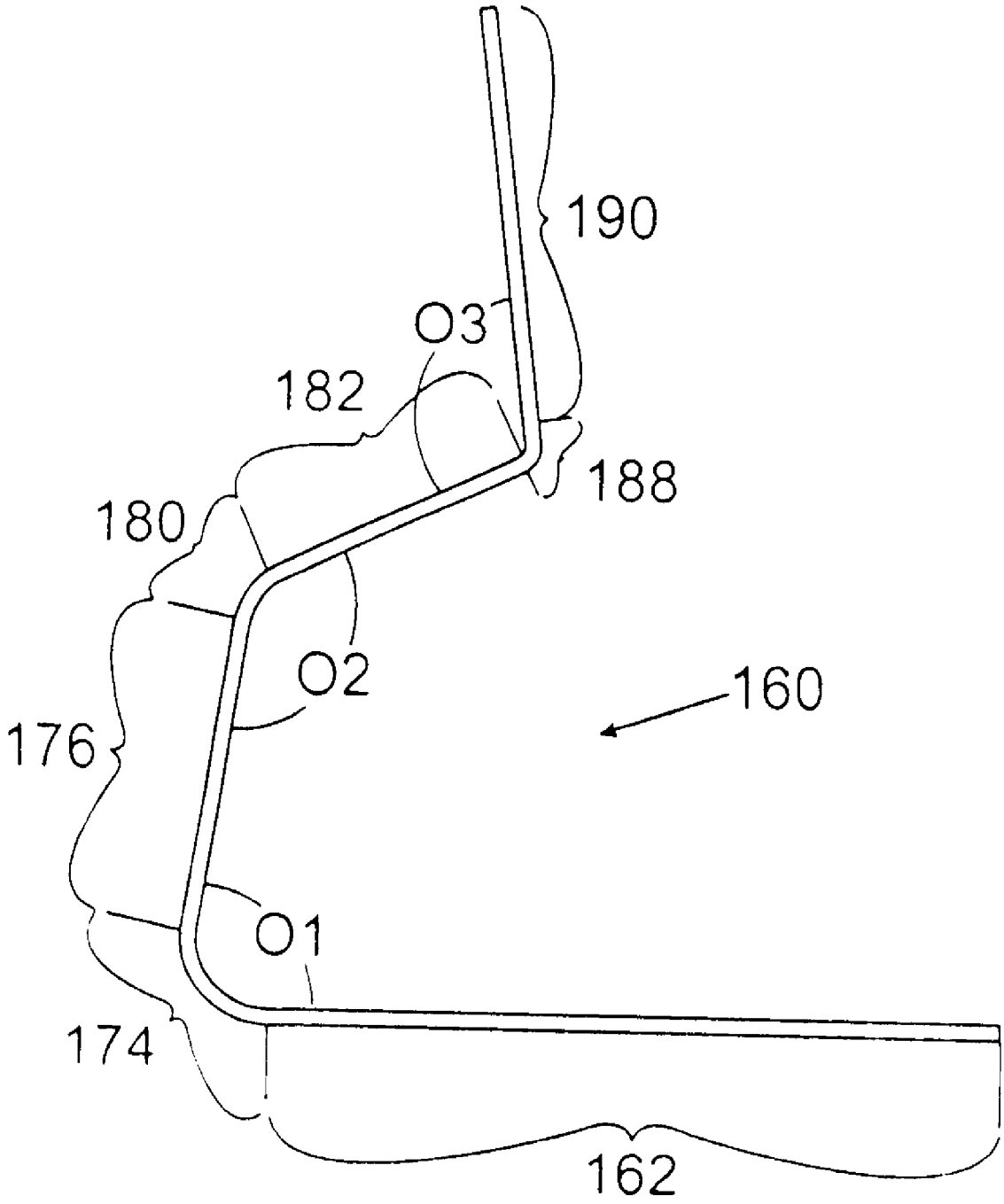
FIG. 4 shows in isolation an embodiment of a backrest support arm configured to provide a desired amount of traction to the spine when the user leans back.

In the preferred embodiment shown in FIG. 4 the backrest support arm 160 preferably comprises a single unitary arm including four distinct sections. The lower end section 162 is intended to couple to the underside of the seat 102, preferably in a manner that allows the back rest support arm 160 to be adjusted backwards or forwards along the length of the lower end section 162 of the back rest support arm 160. This is intended to allow the back rest to be adjusted relative to the seat 102 in order to adjust the depth of the seat 102 to accommodate different users. Virtually any known mechanism for adjusting the depth of the seat 102 may be used, and the particular mechanism selected is not critical to the invention. The number 170 is intended to generally indicate a generic known mechanism for accomplishing the desired adjustability.

The lower end section 162 of the support arm 160 preferably lies approximately horizontal to the ground, and may be of any desired length, but is preferably approximately 12.4 inches. A first bend 174 is made in the backrest support arm 160 between the lower end section 162 and the lower intermediate section 176 of the back rest support arm 160. The turn is preferably configured so that the an angle $\phi 1$ of approximately 82 degrees is made between the lower end section 162 and the lower intermediate section 176. The lower intermediate section 176 is preferably approximately 6.8 inches long.

A second bend 180 is made between the lower intermediate section 176 of the backrest support arm 160, and the upper intermediate section 182 of the backrest support arm 160. The bend preferably creates an angle $\phi 2$ of approximately 54.5 degrees from an axis of the lower intermediate support arm 160, as seen in FIG. 4. The length of the upper intermediate section 182 is preferably approximately 4.7 inches.

A third bend 188 is made between the upper intermediate section 182 and the upper end section 190. The third bend 188 preferably results in an angle $\phi 3$ of approximately 70 degrees between the upper end section 190 and an axis of the upper intermediate section 182. The upper end section 190 may be any length sufficient to support the backrest 104.

The description of the support arm 160 seen in FIG. 4 is provided as an example. The combination of lengths of segments and angles of bends disclosed may be easily modified by one skilled in the art without leaving the spirit and scope of the invention, provided the resulting configuration results in a support arm 160 that provides the desired traction.

Figure 6:
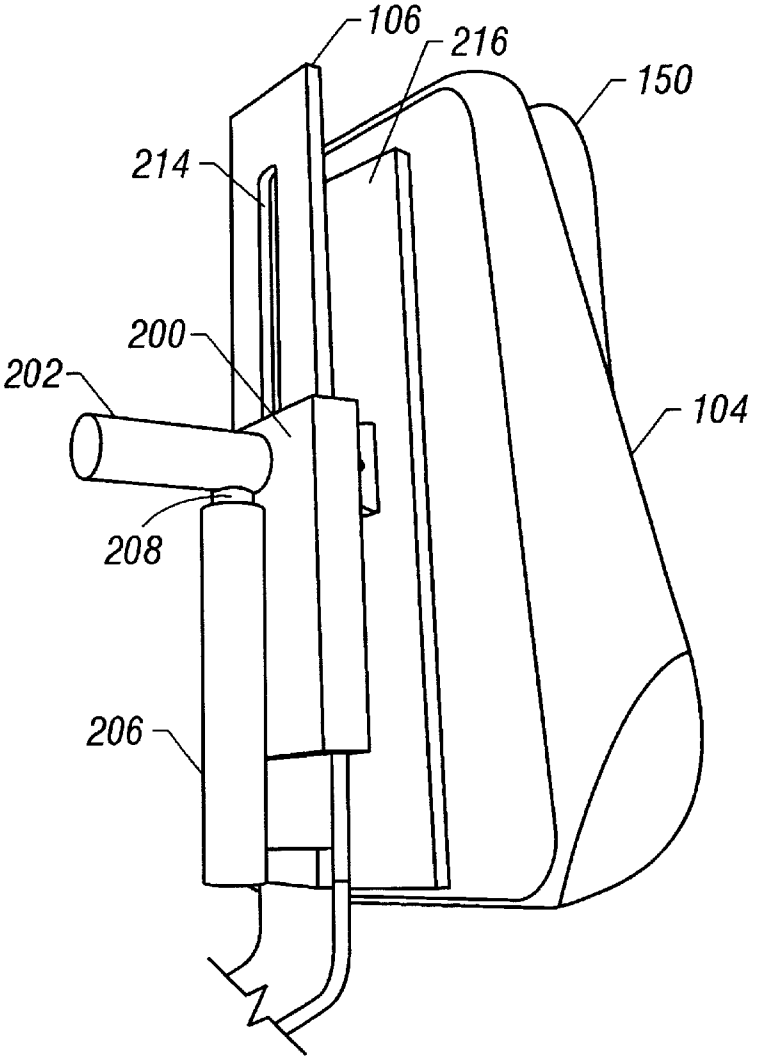
FIG. 6 shows a perspective view of a preferred embodiment of the apparatus for adjusting the height and angle of the backrest relative to the seat of the chair.
Figure 5:
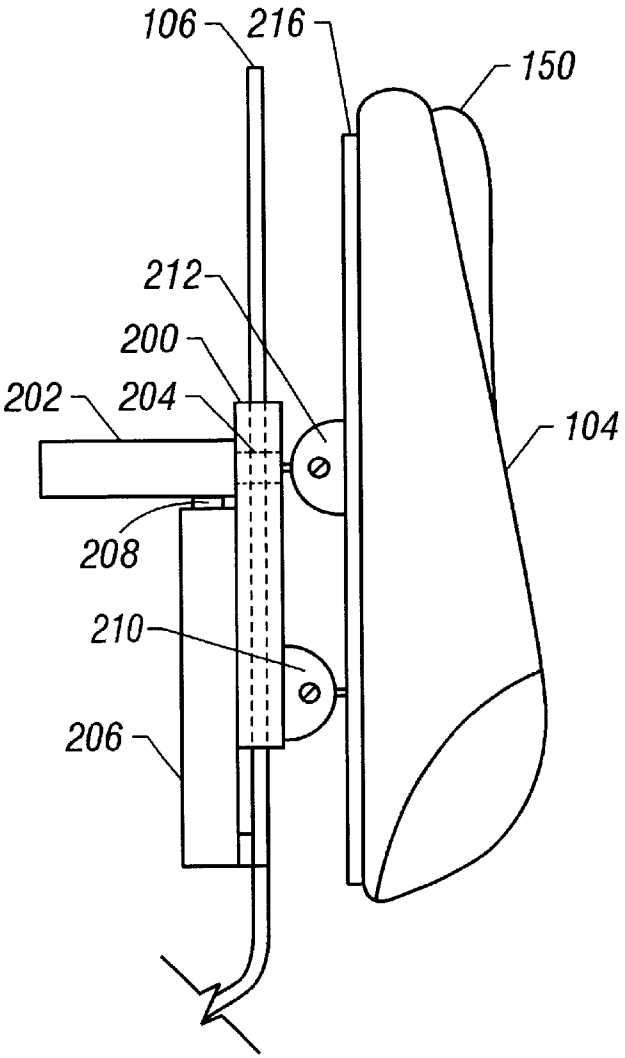
FIG. 5 shows a side view of a preferred embodiment of the apparatus for adjusting the height and angle of the backrest relative to the seat of the chair.

The upper end section 190 is preferably coupled to the back of the backrest 104 in a manner that allows the backrest 104 to be adjusted along the length of the upper end section 190 of the backrest support arm 160. The angle of the backrest is also preferably adjustable. Any known mechanism for adjusting the height and angle of the backrest may be used, however, a preferred embodiment is shown in FIGS. 5 and 6. In this embodiment a collar 200 is fitted over the upper portion 190 of the backrest support arm 106. A first pneumatic cylinder 202 is coupled to the backside of the collar with a first piston 204 extending through aligned opposing apertures on each side of the collar 200, and through a slot 214, seen in FIG. 6, in the backrest support arm 160. A second pneumatic cylinder 206 is positioned below the first pneumatic cylinder 202, with an outer end of the piston 208 of the second pneumatic cylinder 206 being coupled to the first pneumatic cylinder 202. A first pivot 210 is coupled to the front of the collar 200, which is further pivotally coupled to the back plate 216, which is attached to the backrest 104. A second pivot 212 is coupled to the back plate 216 and is further pivotally coupled to an outer end of the piston 204 of the first pneumatic cylinder 202, which extends through the slot 214 in the support arm 160. By adjusting the piston 204 of the first pneumatic cylinder 202, the angle of the backrest 104 may be adjusted. By adjusting the piston 208 of the second pneumatic cylinder 206, the backrest 104 may be adjusted vertically.

To those skilled in the art, many changes and modifications will be readily apparent from consideration of the foregoing description of a preferred embodiment without departure from the spirit of the present invention; the scope thereof being more particularly pointed out by the following claims. The description herein and the disclosures hereof are by way of illustration only and should not be construed as limiting the scope of the present invention which is more particularly pointed out by the following claims. For example, the invention has been disclosed in the context of a desk chair, however, the invention may be incorporated in to many other kinds of chairs or other seating.

What is claimed is:

1. A method of providing support to a target region of a back of a seated person between the $2^{nd}$ lumbar vertebrae and the $11^{th}$ thoracic vertebrae of the spine of the seated person, the method comprising the steps:

(a) providing a backrest including a front surface, a back surface, a top and a bottom, said backrest further including a primary support region on said front surface of said backrest, said backrest being positionable to provide primary support to the target region of the spine of the seated person between the $2^{nd}$ lumbar vertebrae and the $11^{th}$ thoracic vertebrae, (b) positioning said backrest by adjusting at least one dimension of height, depth, and angle of said backrest so that said primary support region of said backrest contacts the target region of the spine between the $2^{nd}$ lumbar vertebrae and the $11^{th}$ thoracic vertebrae of a seated person.

2. The method of claim 1, wherein said backrest does not provide support below the $2^{nd}$ vertebrae.

3. The method of claim 1, wherein said backrest further comprises a triangle-shaped protrusion for providing additional support to the spine of the seated person.

4. The method of claim 1, wherein a force applied by said primary support region of said backrest to the target region of the spine comprises a vector including both a vertical component and a horizontal component.

5. The method of claim 1, wherein said primary support region is located proximate said bottom of said backrest.

6. The method of claim 1, wherein said backrest is positionable to provide primary support to the spine in a region between the $1^{st}$ lumbar vertebrae and the $12^{th}$ thoracic vertebrae.

7. The method of claim 1, further comprising the step (c) applying a selected amount of traction to the spine of the seated person as said backrest is deflected backwards as the seated person leans back.

8. The method of claim 7, wherein said selected amount of traction is between 1/16 inch and 1/4 inch for each 3/4 inch to 1 1/4 inch of backwards deflection of said backrest.

9. The method of claim 8, wherein said selected amount of traction is 1/8 inch for each 1 inch of backwards deflection of said backrest.

10. A method of providing support to a spine of a seated person, the method comprising the steps:

(a) providing a backrest including a front surface, a back surface, a top and a bottom, said seat backrest further including a primary support region on said front surface of said backrest, said backrest being positionable to provide primary support to a target region of the spine of the seated person between a $2^{nd}$ lumbar vertebrae and an $11^{th}$ thoracic vertebrae, (b) positioning said backrest by adjusting one at least dimension of height, depth, and angle of said backrest so that said primary support region of said backrest contacts said target region of the spine between said $2^{nd}$ lumbar vertebrae and said $11^{th}$ thoracic vertebrae of a seated person.

11. The method of claim 10, further comprising the step (c) applying a selected amount of traction to the spine of the seated person as said backrest is deflected backwards as the seated person leans back.

* * * * *